US005152731A

United States Patent [19]

Troutman

[11] Patent Number: 5,152,731

[45] Date of Patent: Oct. 6, 1992

[54] BARBELL HAVING AXIALLY MOVABLE GRIPS

[76] Inventor: Zina S. Troutman, 3303 N. Sunridge La., Chandler, Ariz. 85224

[21] Appl. No.: 738,192

[22] Filed: Jul. 30, 1991

[51] Int. Cl.[5] ..... A63B 21/072

[52] U.S. Cl. ..... 482/106

[58] Field of Search ..... 272/123; 482/93, 106, 482/108, 109, 139

[56] References Cited

U.S. PATENT DOCUMENTS

| | | | |
|---|---|---|---|
| 3,756,597 | 9/1923 | Monti . | |
| 3,938,803 | 2/1976 | Wilmoth et al. . | |
| 4,455,020 | 6/1984 | Schnell | 272/123 |
| 4,531,729 | 7/1985 | Wrinkle . | |
| 4,585,229 | 4/1986 | Brasher | 272/123 |
| 4,618,142 | 10/1986 | Joseph, Jr. | 272/123 X |
| 4,743,018 | 5/1988 | Eckler | 272/123 |
| 4,822,035 | 4/1989 | Jennings et al. | 272/123 |
| 4,913,417 | 4/1990 | Francu . | |
| 4,978,122 | 12/1990 | Dibowski . | |

*Primary Examiner*—Robert Bahr

*Attorney, Agent, or Firm*—Schmeiser, Morelle & Watts

[57] ABSTRACT

The invention is a barbell-type exercise device in which the grips are freely movable on the bar of the device. Each grip includes a number of bearings that allow the grip to slide along the bar without resistance. The grips and bar include complementary anti-rotation apparatus that prevents the grips from rotating about the longitudinal axis of the bar. A number of adjustable stop members may also be placed on the bar to limit the axial travel of the grips.

10 Claims, 2 Drawing Sheets

BARBELL HAVING AXIALLY MOVABLE GRIPS

FIELD OF THE INVENTION

The invention is in the field of exercise equipment. More particularly, the invention is a type of barbell in which the grips are movable to thereby enable the user to slide his or her hands along the bar while using the device.

BACKGROUND OF THE INVENTION

In the practice of bodybuilding, the individual strives to develop a well-defined, muscular and symmetrical body. There are many types of devices commonly employed to aid in achieving this goal. Of these devices, the free weight type, as typified by barbells and dumbbells, is the most basic. Correct use of these devices not only improves the user's muscle tone but also improves the user's balance and coordination.

Weight lifting is an isotonic exercise in which the individual contracts his or her muscles against a resistance that is moved through a range of motion. The resistance is normally in the form of a weighted object that the user moves through either a flexion or extension of his or her arms or legs.

Barbells are one of the most common devices used in weight lifting. A barbell will normally comprise a straight bar that has a medial hand grip area and weights removably received on the bar's outer ends. Some modified types of barbells employ bars with arcuate portions such as an E-Z CURL BAR. There are other modifications that have been made to the basic barbell including the use of rotatable grips and grips that can be moved against a resistance.

In weight lifting, there are a number of exercises in which the user moves a weighted barbell in order to strengthen his or her upper body muscles. One example of such an exercise is a bench press in which the individual initially assumes a supine position atop a support bench. The weight lifter then uses his or her arms to lift the barbell from a position just above the lifter's chest to a higher vertical position where the lifter's arms are fully extended. This exercise is normally accomplished without any sideways movement (abduction or adduction) of the lifter's hands. This basic exercise can be modified by inclining the support bench (inclined press) or by starting with the bar substantially coplanar with the user's torso (pull overs).

Barbells can also be employed when the lifter is in a standing position. An example of this type of exercise is the overhead or standing military press. In this exercise, the lifter uses his or her arms to lift the barbell from armpit height to a position where it is located above the lifter's head. Another type of standing exercise employing a barbell is upright rowing in which the lifter moves the barbell with his or her hands in a rowing motion.

Many exercises that can be performed with a barbell can also be performed using a pair of dumbbells. A dumbbell is basically a scaled-down version of a barbell that is designed to be grasped by a single hand of the user. The user will normally hold the dumbbells with one in each hand to perform press-type or similar exercises.

Dumbbells can also be used to perform exercises in which the user's hands are swung away or toward the centerline of the his or her body. In a dumbbell fly exercise, the abduction/adduction type of sideways arm movements function to strengthen the user's pectoral or chest muscles. For example, a female weight lifter will normally start with the dumbbells located at her side with her arms extended outward forming a "T"-shaped with her upper body. Next, she swings her arms in an arc bringing the dumbbells into a position above the centerline of her body. The dumbbells are then swung back to the original starting position.

While for many exercises barbells and dumbbells can be used interchangeably, there are certain types of exercises for which this is not the case. A barbell cannot easily be used for exercises in which abduction/adduction-type movements are required. This significantly limits the user of a barbell who wishes to strengthen his or her muscles through both a lifting and sideways arm movement. A well known advantage of a barbell is that it provides a balanced resistance to both arms at the same time. It is extremely difficult for a user of dumbbells to achieve the same balance and coordination of his or her arm muscles while using two dumbbells that are independently movable.

SUMMARY OF THE INVENTION

The invention is a unique barbell-type of exercising device in which the user can freely slide the grips along the central portion of the bar. This enables a user to employ the device for both press-type exercises and exercises in which the user moves his or her hands in a sideways direction.

The improved barbell-type device includes a central bar to which weights are received on each end. The invention further includes a pair of cylindrically-shaped movable grips that are slidably mounted on the central portion of the bar. The grips and bar have complementary structures that allow the aforesaid sliding movement while maintaining the grips on the bar in a stable, non-rotatable manner.

In the preferred embodiment, the complementary structure that prevents rotation of the grips comprises a plurality of longitudinally-extending grooves spacedly located on the surface of the bar and a plurality of bearings retained in a stationary position within the interior bore of the grips. The bearings located in each grip are each secured in a housing that is fixed to the grip in a manner that does not allow the housing to rotate. While each bearing is free to spin in place, the housings are designed so that the individual bearings cannot change their position within the housing. A portion of each bearing extends into the grip's bore and is partially received within the aforesaid grooves thereby preventing the grips from rotating on the bar.

The grips are designed so that they can each be moved along the bar by the user with little or no resistance to their axial movement. To prevent the grips from contacting flanges that abut the weights, adjustable stops are located on the bar proximate the flanges. The stops can also be adjusted along the bar to limit the grip's outward travel to any desired position suitable for a particular exercise and/or to limit the grip travel to adapt the device to suit the physical dimension's of the user's body. Another pair of adjustable stops are also located on the bar between the grips. This second pair of stops adjustably limits the inward travel of the grips along the bar to also suit the particular exercise or user.

The improved barbell can be employed by a weight lifter to combine the movements used in both press and fly-type exercises. For example, a male weight lifter using the improved barbell can move his hands inwardly along the bar while lifting the barbell during a press-type exercise. Once the barbell has been lifted to a point where the lifter has his arms fully extended, he will have moved the grips to a position where they are closely spaced on the bar. As the lifter returns the barbell to its original starting position, his hands move the grips outwardly along the bar until the barbell is again proximate the lifter's body. At this point, the lifter's hands will be spaced relatively far apart on the bar. The user will normally adjust the inner and outer stops accordingly to meet these grip locations.

The invention can be used to perform all of the previously mentioned barbell excises in a more comfortable manner than is allowed by prior art barbells. In addition, when the user is able to move his or her arms in a sideways motion during an exercise, the user's muscles are conditioned in much the same manner as they are when the user moves dumbbells through an arcuate path.

A first objective of the invention is to provide a device that enables a user to combine the exercise movements that were previously limited to either a barbell or to a pair of separate dumbbells.

A second objective of the invention is to provide a barbell-type device that enables a sliding movement of the grips while maintaining the grips in a stable, level position. This eliminates any cocking of the grips which might result in the grips binding on the bar and thereby affecting the balance of the device and the free movement of the grips on the bar.

A third objective of the invention is to provide a barbell-type device in which the grips can freely slide in an axial direction on the bar without rotating. A rotative movement of the grips would reduce the user's control of the device thereby possibly reducing the stability of the barbell when it is in use.

A fourth objective of the invention is to provide a barbell-type device that has axially movable grips and has adjustable structure on the bar that is used to limit the aforesaid movement of the grips. The use of movable limit structure allows the user to configure the device in accordance with the requirements of any particular exercise and/or to conform to the limitations dictated by the dimensions of the user's body.

DETAILED DESCRIPTION OF THE DRAWINGS

Figure 1:
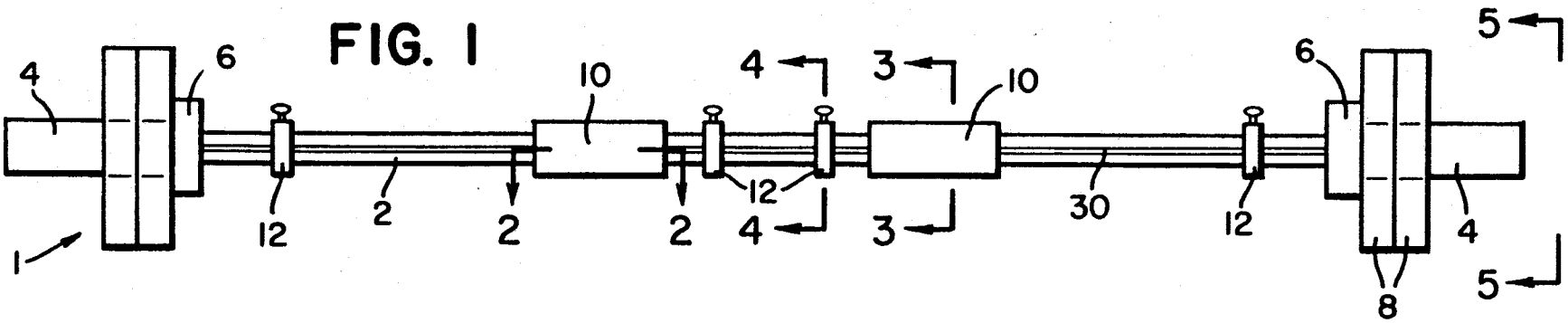
FIG. 1 is a front view of a barbell-type device in accordance with the invention.

Referring now to the drawings in greater detail, wherein like reference characters refer to like parts throughout the several figures, there is shown by the numeral 1 a barbell-type device in accordance with the invention.

The device includes a central bar 2 that is approximately eighty-six inches in length. At each end of the bar is a large diameter weight receiving member 4 that has a flange 6 located at its inner end. In FIG. 1, two weights 8 are shown located on each member 4 with the member extending through a central bore in each weight. The innermost weight is shown abutting the outer side of the flange 6. In the preferred embodiment, no weight securing apparatus is located on the outer portion of member 4. This enables the weights to slide off the end of the bar if the bar should become tipped. Adjustable weight fixing clamps, as are commonly found in the prior art, may be optionally employed on the outer end of each member 4.

Slidably mounted on the central portion of the bar between the flanged members 4 are a pair of cylindrical grips 10. Each grip is preferably made from a metal such as steel or aluminum.

There are four stop members 12 located on the bar to limit the axial travel of the grips. The stop members are in the form of adjustable clamps that the user can loosen to enable the repositioning of the clamp along the bar. As shown in FIG. 1, there are two stop members located between the grips that function to limit the inward travel of the grips. As also shown, there are two stop members located on the bar outboard of the grips that function to limit the outward travel of each grip. It should be noted that the device can be used without any clamps in place. However, the use of the clamps customizes the barbell to the user or to the particular exercise and thereby facilitate the use of the device.

Figure 3:
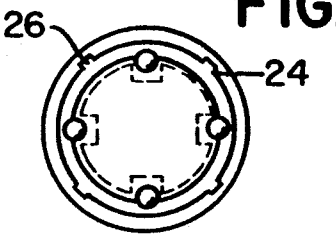
FIG. 3 is an end view of the grip shown in FIG. 2 with the bar shown in phantom.
Figure 2:
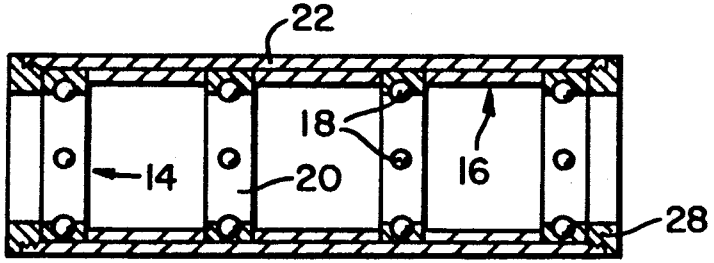
FIG. 2 is a cross-sectional view of one of the grips.
Figure 5:
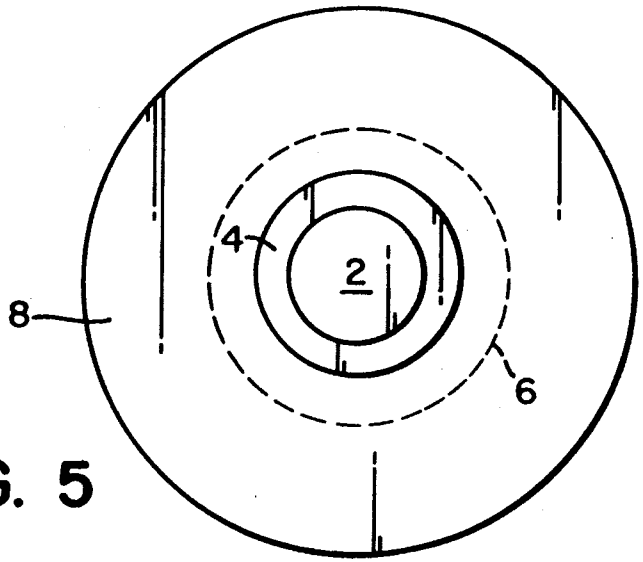
FIG. 5 is an end view of the device shown in FIG. 1.

FIG. 2 provides a cross-sectional view of one of the grips. FIG. 3 provides an end view of the grip shown in FIG. 2.

Each of the grips has four sets of evenly-spaced bearings 14 located concentrically with the grip's axially oriented inner bore 16. The bearings are located in a manner whereby they provide uniform support and prevent cocking of the grip on the bar. Each bearing set includes a plurality of individual ball bearings 18 that partially protrude into the grip's inner bore. The ball bearings are located in a circular housing 20 that functions to maintain the position of each ball bearing yet allows the ball bearings to rotate in place. This is achieved through the shape of the housing whereby it surrounds a major portion of each ball bearing in a manner similar to the removable bearing sets commonly found in many bicycles. In the preferred embodiment shown, each bearing set has four ball bearings with each ball bearing located at ninety-degree arcuate intervals along the housing.

As can be seen in FIG. 2, there are three spacer-rings 22 located within the bore of each grip to maintain the position of the ball bearing sets. Locking means are also located within the bore of each grip to prevent the ball bearing housings from rotating. The locking means preferably comprise complementary grooves 24 located along the interior face of the grip bore that receive outwardly projecting tabs 26 situated on the exterior surface of the bearing housings. Each end of the grip bore is threaded and a threaded endcap 28 is inserted into each end of the grip to maintain the position of the bearing sets and spacer rings within the bore of the grip.

It should be noted that other types of fixing means can be used to maintain the position of the bearing sets and to thereby prevent their rotation. For example, the bearing housings can be fixedly placed within a plastic sleeve that is tightly received within the bore of the grip. When the bearing sets are properly located within the grip, each ball bearing partially protrudes the same distance into the bore of the grip.

Figure 4:
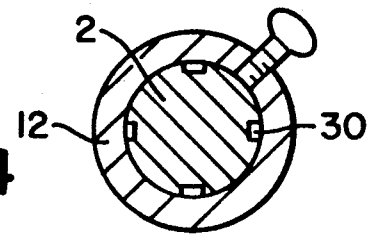
FIG. 4 is a cross-sectional view of a central portion of the bar with one of the stop members also shown.

As can be seen in FIG. 4, the bar 2 includes a plurality of longitudinally extending spaced grooves 30 along its outer surface that function to receive the portion of the ball bearings that protrude into the bore of each grip. In the preferred embodiment, there are a total of four grooves on the cylindrical bar with each groove located ninety degrees from its neighbor along the circumference of the bar.

When the grips are located on the bar in the manner shown in FIG. 1, the ball bearings in the grips extend into the grooves in the bar and allow the grips to slide along the bar with substantially no resistance. The grooves in the bar also act in a complementary fashion with the ball bearings and the bearing housing locking means to prevent the grips from rotating on the bar.

Figure 6:
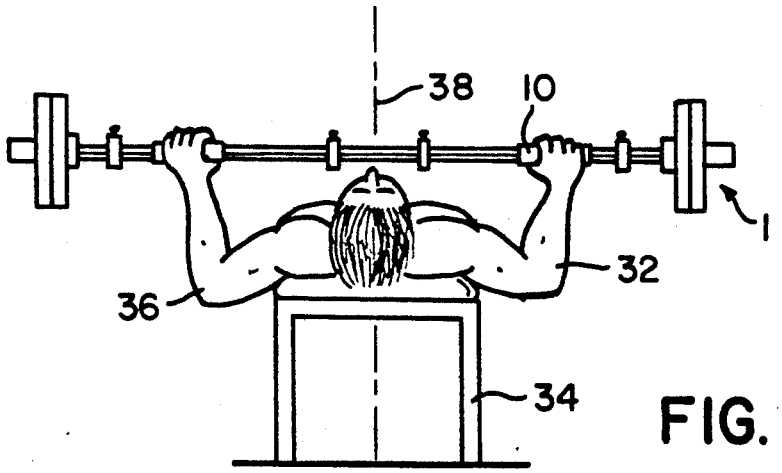
FIG. 6 is an elevational front view of the device being supported by a user at a position proximate the user's chest.
Figure 7:
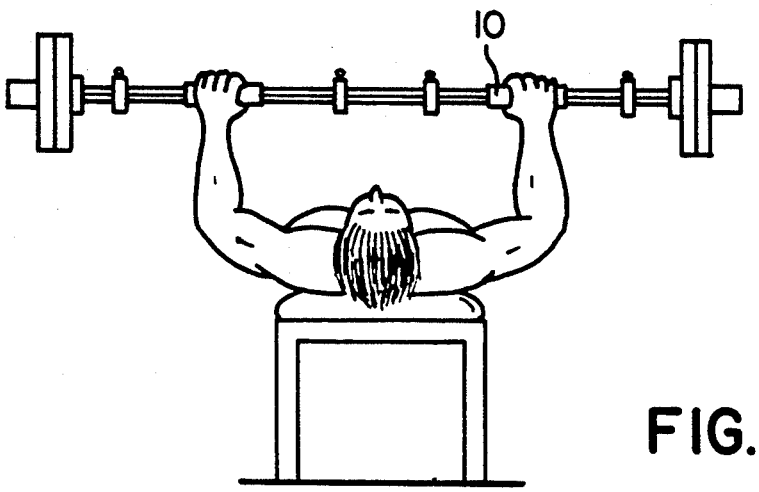
FIG. 7 is an elevational front view of the device being supported by a user at an intermediate raised position.
Figure 8:
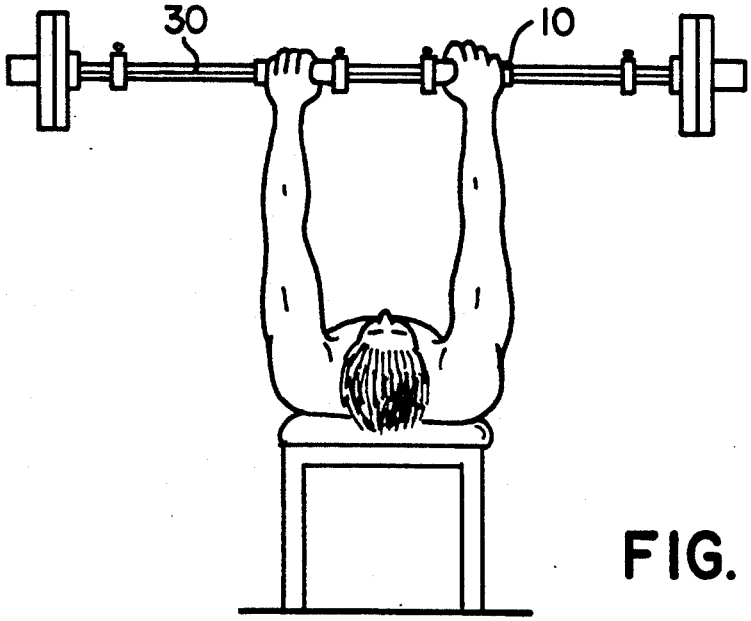
FIG. 8 is an elevational front view of the device being supported by a user at a fully raised position.

FIGS. 6, 7 and 8 provide an example of how the device can be employed by a user to combine a dumbbell fly-type exercise with a barbell press-type exercise.

In FIG. 6, a user 32 is in a supine position with his back resting on a support bench 34. The device 1 is supported at slightly above chest height and the lifter has his upper arms at a slight downward angle. Normally, in this starting position, the user's elbows 36 will be positioned slightly below the top of the support bench. The lifter's hands are positioned on the grips 10 with the grips spaced relatively far apart on the bar. At this point, the lifter is about to press/lift the device in an upward direction.

FIG. 7 shows the user at an intermediate lifting position. The device has been raised approximately halfway to the farthest point it will travel to during the exercise. The user's arms are partially extended and it can be seen that his hands have moved toward each other on the bar and thereby closer to the vertical centerline 38 of his body. As can be seen in this figure, the inward movement of the user's hands have caused the grips to slide inwardly on the bar thereby allowing the lifter to maintain a comfortable hand position during the arm movement. It should be noted that this adduction of the arm is similar to that required during a dumbbell fly exercise with a subsequent similar conditioning of his muscles.

In FIG. 8, the lifter has fully extended his arms upwardly and thereby raised the barbell to its highest position of travel. By thus doing, the lifter has brought his elbows and hands inwardly to a point near his body centerline 38. As a result, the grips have traveled on the bar to a point where they are relatively closely spaced with their inner ends proximate two of the stops 12. Through lifting the device, the user has accomplished an arm movement that exercises the arm and chest muscles in the same manner as achieved in both dumbbell fly and barbell press-type exercises.

The lifter would then reverse the above steps and return the device to its original starting position.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A barbell-type exercise device comprising:

an elongated bar member having first and second ends;

weight receiving means located proximate said first and second ends of said bar member for removably receiving weights;

first and second grip members slidably mounted on a center portion of said bar member wherein said grip members can be freely moved on said bar member in a direction parallel to a longitudinal axis of said bar member and complementary anti-rotation means located on said grip members and directly on said bar member that functions in a manner whereby the grip members are not rotatable about the longitudinal axis of said bar member.

2. The device of claim 1 wherein each of said grip members includes bearing means that contacts an exterior surface of said bar member and allows said grip member to slide along the surface of said bar member substantially free of resistance.

3. The device of claim 2 wherein said bearing means comprises a plurality of bearing sets that each have a housing and a plurality of bearing members secured within said housing and wherein each of said grip members includes means located proximate a central bore for preventing the housings of said bearing sets from rotating within the grip member.

4. The device of claim 1 wherein the anti-rotation means comprises a plurality of extending members that fit within a plurality of matched grooves.

5. The device of claim 1 wherein the first and second grip members make up a pair of grip members and the anti-rotation means comprises a plurality of movable extending members located on one of either the bar member or the pair of grip members and wherein the extending members fit within a plurality of matched grooves located on the other of said bar member or pair of grip members.

6. The device of claim 1 wherein the anti-rotation means comprises a plurality of inwardly extending members located on an interior surface of each of said grip members that fit within a plurality of longitudinally extending grooves located on an exterior surface of said bar member.

7. The device of claim 6 wherein each of said grip members includes a plurality of bearing means located proximate a central bore of said grip member and wherein each of said bearing means comprises a plurality of ball bearings oriented in a manner whereby a portion of each ball bearing extends into the central bore of the grip member and forms one of the extending members of said anti-rotation means.

8. The device of claim 1 further comprising a plurality of adjustable stop members located on said bar member wherein the stop members can be adjustably positioned on the bar member to limit the travel of the movable grip members on the bar member.

9. The device of claim 1 further comprising a plurality of adjustable stop members that are located on said bar member between the grip members and the weight receiving means wherein the stop members can be adjustably positioned on the bar member to limit the distance the movable grip members can travel outwardly on the bar member in the direction of the weight receiving means.

10. The device of claim 9 further comprising a plurality of adjustable stop members located on said bar member between the grip members wherein the stop members located between said grip members can be adjustably positioned on the bar member to limit the distance the movable grip members can travel inwardly on the bar member toward each other.

* * * * *